US005893950A

United States Patent [19]

Martinoni et al.

[11] Patent Number: 5,893,950

[45] Date of Patent: Apr. 13, 1999

[54] METHOD AND APPARATUS FOR APPLYING A WATER-BASED COATING COMPOSITION TO A SUBSTRATE

[75] Inventors: Raffaele Martinoni, Zurich; Paul Böhler, Uetikon; Christian Schmid, Jona, all of Switzerland

[73] Assignee: The Dexter Corporation, Windsor Locks, Conn.

[21] Appl. No.: 08/903,882

[22] Filed: Jul. 31, 1997

[51] Int. Cl.[6] ..... B05D 3/00; B05D 1/02; B05D 1/28; B05D 1/36

[52] U.S. Cl. ..... 118/66; 34/381; 34/391; 34/446; 34/429; 118/56; 118/59; 118/69; 118/101; 118/300; 118/244; 427/335; 427/374.2; 427/374.5; 427/374.6; 427/377; 427/398.1; 427/398.2; 427/398.3; 427/398.4; 427/421; 427/428

[58] Field of Search ..... 427/335, 336, 427/348, 374.1, 374.2, 374.6, 374.5, 398.2, 398.1, 398.3, 398.4, 377; 118/56, 59, 66, 69, 101, 300, 244; 34/381, 429, 391, 392, 393, 390, 474, 476, 446

[56] References Cited

U.S. PATENT DOCUMENTS

| | | | |
|---|---|---|---|
| 3,979,535 | 9/1976 | Gividan | 427/422 |
| 4,051,278 | 9/1977 | Democh | 427/374.2 |
| 4,073,975 | 2/1978 | Buckwalter et al. | 427/335 |
| 4,292,349 | 9/1981 | Ishiwata et al. | 427/335 |
| 4,347,302 | 8/1982 | Gotman | 427/335 |
| 4,438,159 | 3/1984 | Weber | 427/335 |
| 4,581,257 | 4/1986 | Kondo et al. | 427/374.2 |
| 4,732,784 | 3/1988 | Laroche et al. | 427/335 |
| 5,245,920 | 9/1993 | Hess | 427/398.4 |
| 5,462,768 | 10/1995 | Adkins et al. | 427/282 |
| 5,753,305 | 5/1998 | Smith et al. | 427/335 |

OTHER PUBLICATIONS

P.W. Dillon, *Journal of Coatings Technology*, vol. 49, No. 634, Nov. 1977, pp. 38–49.

W. Funke et al., *Farbe Lack*, vol. 85, No. 11, pp. 916–919 (1979), Abstract in English. (No Month).

G. LeRose, *Vernaciatura Del Legno*, No. 77, Nov., 1995, pp. 14–16, no translation.

Anon., *R & D Magazine*, Sep., 1997, pp. 52 and 53.

*Primary Examiner*—Diana Dudash
*Attorney, Agent, or Firm*—Marshall, O'Toole, Gerstein, Murray & Borun

[57] ABSTRACT

A method and apparatus that prevents premature drying of a layer of a water-based coating composition on a substrate are disclosed.

22 Claims, 6 Drawing Sheets

METHOD AND APPARATUS FOR APPLYING A WATER-BASED COATING COMPOSITION TO A SUBSTRATE

FIELD OF THE INVENTION

The present invention is directed to an improved method of applying a water-based coating composition to a substrate. The invention also is directed to an apparatus for applying a water-based coating composition to a surface of a substrate.

BACKGROUND OF THE INVENTION

Investigators have developed coating compositions that are free of organic solvents, or at least incorporate a minimum amount of organic solvents, in order to avoid the environmental, toxicological, and safety problems associated with organic solvents. As a result, water-based coating compositions, including pigmented coatings, are being used in more and varied applications. In particular, water-based coating compositions, including solutions, emulsions, and dispersions, have properties that make them suitable for application to a variety of substrates, both metal and non-metal.

However, water-based coating compositions have different application characteristics from solvent-based coating compositions. For example, many water-based coating compositions exhibit a poor flow during roller application, which results in stripes (i.e., zones of uneven film thickness) appearing during, and after, application of the coating composition to the substrate. The stripes typically remain after the curing, or air drying, of the coating composition layer. The substrate, therefore, has a coating of uneven thickness which can adversely affect the esthetics of the coated substrate and/or the barrier properties of the coating.

In order to demonstrate good flow, a coating composition applied in a roller coating application must remain in the liquid phase for a sufficient time to form a uniform layer of the coating composition on the substrate. With solvent-based coating compositions, the drying time can be adjusted, or optimized, by a judicious selection of specific solvents. In a very limited way, drying time adjustments also can be done with water-based coating compositions. However, such adjustments are not desirable and are of very limited benefit for water-based coating compositions.

It has been observed that water-based coating compositions exhibit flow problems because the coating composition dries too quickly, i.e., before the desired curing of the coating composition on the surface of the coated substrate. Accordingly, spreading the coating composition over the entire surface of the substrate to provide a coating layer of uniform thickness is hindered. For example, when a water-based coating composition is applied by a spreading blade onto a substrate, only incompletely merged strip patterns are formed, and the desired coating layer does not coat the substrate evenly.

Additional problems result because the water-based coating composition also has a tendency to dry on the application device, such that uniformity of the coating on the substrate is adversely affected. In direct, gravure, or reverse roll coating applications, the formation of a skin is evidence of drying of the coating composition on the roll surface and in the edge zones. In addition, in spray applications, drying of the coating composition produces clogged spray nozzles. Troublesome and time-consuming cleaning operations then are necessary, which adversely affect the continuous operation of the application equipment.

These problems result because the physical properties of a water-based coating composition are closely related to the properties of water. As stated above, water-based coating compositions typically have poor flow properties during roller coating application. There are several reasons for poor flow, such as high surface tension, rheological properties, and the relatively fast drying of the water-based coating compositions. An important reason for the relatively fast drying speed of water-based coating compositions is the fast evaporation rate of water, or water azeotropes, compared to solvent-based coating compositions.

It is possible to prevent or retard the undesirable, premature drying of water-based coating compositions by the addition of solvents, but this negates the primary objective of a water-based coating composition, i.e., avoiding the use of organic solvents. Accordingly, the present invention is directed to a method and apparatus that prevents premature drying of water-based coating compositions that are applied to the surface of a substrate.

SUMMARY OF THE INVENTION

The present invention relates to an improved method and apparatus for applying a water-based coating composition to a substrate. More particularly, the present invention relates to a method and apparatus for improving the flow of a water-based coating composition, such that application of a film of the water-based coating composition to a substrate provides a coating of uniform thickness.

Therefore, one aspect of the present invention is to provide a method of applying a layer of a water-based coating composition to a substrate, wherein the coating composition is humidified during and/or after application to the substrate.

Another aspect of the present invention is to humidify the layer of water-based coating composition by exposing the coated substrate to an atmosphere that is humidified, and/or by cooling the coated substrate.

Another aspect of the present invention is to humidify the layer of water-based coating composition by humidifying the atmosphere surrounding the substrate during application of the coating composition to the substrate.

Yet another aspect of the present invention is to retard evaporation of water from a layer of a water-based coating composition on a substrate, thereby avoiding an increase in viscosity of the coating layer, which in turn allows the coating composition to flow and form a coating layer of uniform thickness on the substrate.

Another aspect of the present invention is to provide an apparatus that humidifies a layer of a water-based coating composition on a substrate and/or prevents premature drying of the coating composition on the substrate.

These and other novel aspects and advantages of the present invention will become apparent from the following detailed description of the preferred embodiments.

DETAILED DESCRIPTION OF THE PREFERRED EMBODIMENTS

A serious problem encountered in the application of a thin coating layer of a water-based coating composition on a substrate is the relatively rapid drying rate of the composition. Premature drying of the coating layer results in a coating of uneven thickness on the substrate.

To achieve a coating of uniform thickness, the applied coating layer must flow and spread on the substrate. The desired uniform spreading of the coating composition on the substrate is adversely affected by the changing rheological properties of the water-based coating composition caused by evaporation of water, and by the high surface tension of the water. In accordance with an important feature of the present invention, it has been found that spreading of a water-based coating composition on a substrate surface is improved substantially when premature drying of the coating layer retarded and the composition is kept wet until the desired drying, or curing, of the coating composition is performed.

Reducing the tendency of the layer of coating composition to dry prematurely can be achieved by exposing the coated substrate to an atmosphere that is substantially, or fully, saturated, or even super-saturated, with water vapor. As a result, evaporation of water from the coating layer is prevented. This type of humidifying atmosphere can be provided, for example, by introducing a water vapor or a water spray to the atmosphere surrounding the layer of coating composition. Alternatively, or in addition to humidifying the coating layer, the coated substrate can be cooled to retard evaporation of water from the coated substrate. In addition, humidification overcomes the problem of dried water-based coatings on application equipment, which adversely affect roll installations during downtime and clog spray nozzles.

In referring to the figures, FIGS. 1 through 3 illustrate the results of experiments using tinplate sheets as the substrate. A layer (about 10μ thick) of a water-based epoxy acrylic white enamel coating composition (i.e., coating composition 94/52/133 A, available from the Dexter Corporation, Waukegan, Ill.) was applied to the tinplate substrate. Photographs of the coated substrates are replicated in FIGS. 1–3, wherein regions of the substrate that are free of a coating layer appear as dark strips. These areas are free of a coating layer because of premature drying, and poor spreading, or flow, of the applied coating composition.

Figure 1A:
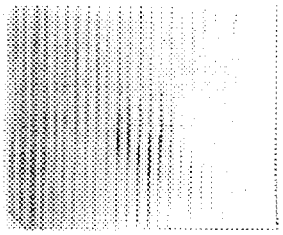
FIGS. 1 and 2 illustrate spreading, i.e., flow, of a water-based coating composition on a substrate under increasing humidity conditions.
Figure 1B:
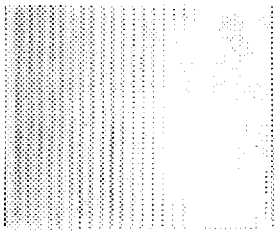
Figure 1C:
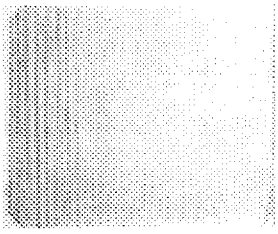

With further respect to FIG. 1, the coating composition was applied using a bar coater. The freshly coated tinplate sheets then were placed in a humidified desiccator. In FIG. 1*a*, the desiccator contained warm water (about 50° C.); in FIG. 1*b*, the desiccator contained water heated to a higher temperature (about 80° C.); in FIG. 1*c*, water vapor was introduced into the desiccator to simulate a vapor zone.

FIG. 1 shows that the number and width of the dark strips (i.e., amount of uncoated substrate) clearly diminished from FIG. 1*a* to FIG. 1*c*, i.e., with increasing humidity of the atmosphere in the desiccator, and that spreading of the coating composition on the substrate was improved substantially as the humidity of the atmosphere increased.

Figure 2A:
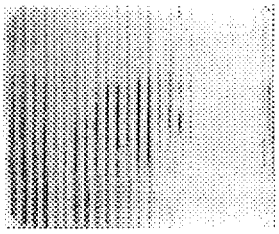
Figure 2B:
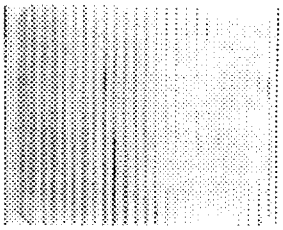
Figure 2C:
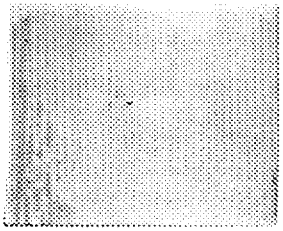
Figure 3A:
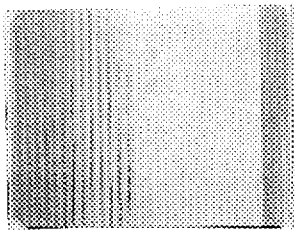
FIG. 3 illustrates flow of a water-based coating composition on a substrate over time at a constant humidity.
Figure 3B:
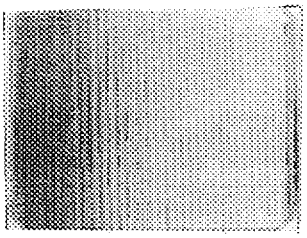
Figure 3C:
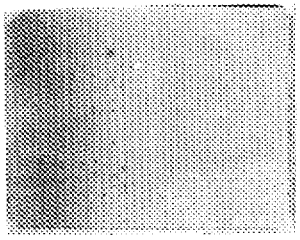
Figure 3D:
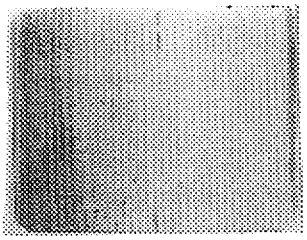
Figure 3E:
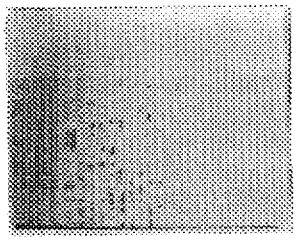
Figure 3F:
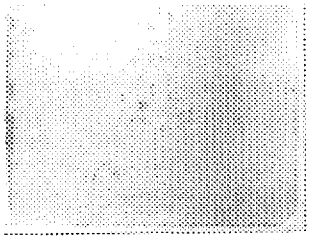

With respect to FIG. 2, the coating composition was applied using a bar coater, then the coated tinplate sheets were placed, for different lengths of time, on a metal block that was cooled to a temperature at which the saturation vapor pressure of water vapor in the atmosphere was reached or surpassed. The experiment depicted in FIG. 2*a* was conducted with the shortest cooling time (about 30 seconds); the experiment depicted in FIG. 2*b* cooled the coated substrate for a longer time (about 60 seconds), and the experiment depicted in FIG. 2*c* cooled the coating substrate for the longest time (about 180 seconds). FIG. 2 shows that the number and width of the dark strips clearly diminished from FIG. 2*a* to FIG. 2*c*, i.e., with an increased cooling time, and that spreading of the coating composition on the substrate was improved substantially.

With respect to FIG. 3, the coating composition was applied to tinplate substrates, then the coated substrates were placed in a vessel containing an aerosol generator. This test simulates placing a coated substrate in a mist zone. The coated substrates were allowed to remain in the mist zone for different lengths of time, i.e., 0, 30, 60, 90, 120, and 150 seconds (FIGS. 3*a*–3*f*, respectively). FIG. 3 shows that the number and width of the dark strips diminished with the length of time the coated substrates were present in the mist zone, and that spreading of the coating layer on the substrate was improved substantially.

FIGS. 1–3 illustrate that flow of a coating composition layer on a substrate can be improved, and thereby provide a finished coating of uniform thickness on the substrate by eliminating premature drying of the coating composition on the substrate. FIGS. 1–3 further illustrate that coating composition flow can be improved by increasing the humidity of the air surrounding the coating substrate. The air surrounding the coated substrate can be humidified to near (i.e., to within 10° C., and preferably to within 5° C.), at, or below the saturation point, or dew point, of the air, either by the addition of water, in the form of a mist or vapor, or by a reduction in temperature.

It has been determined that the maximum amount of water vapor that air can absorb at a particular temperature, is determined by the saturation pressure (Ps) associated with that temperature. If the air is already saturated, it cannot absorb additional moisture. To prevent premature drying of a coating film, it is therefore desirable to adjust the humidity of the atmosphere surrounding the coating film to near, at, or even above, the dew point, i.e., saturation line, for a particular temperature.

The saturation line, which is the absolute vapor content of saturated air as a function of temperature, is given by the equation:

$$Xs(T)=a\cdot ps(T)/(p-ps(T)),$$

wherein a=constant (for water 0.622), ps(T)=saturation pressure at temperature T, Xs(T)=humidity (g solvent/kg air), and p=total pressure. With respect to a water/air system, the equation therefore is:

$$Xs(T)=0.622\cdot pWD(T)/(p-pWD(T)),$$

wherein pWD(T)=saturation pressure of water at temperature T.

Figure 4:
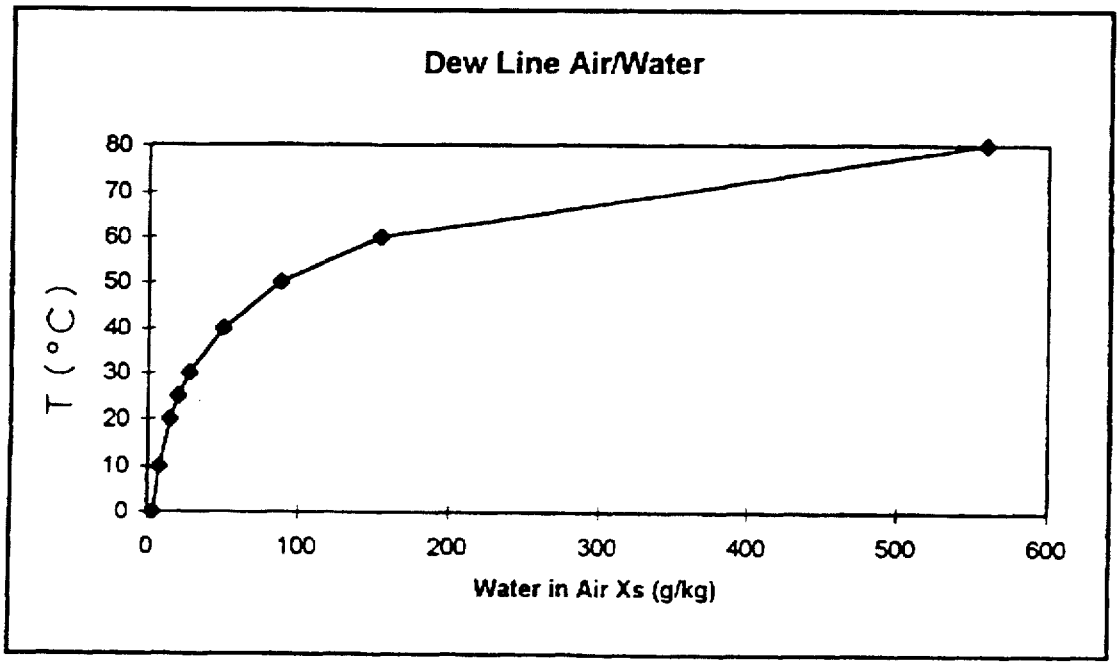
FIGS. 4 and 5 are plots of water in air (g/kg) vs. temperature (°C.)
Figure 5:
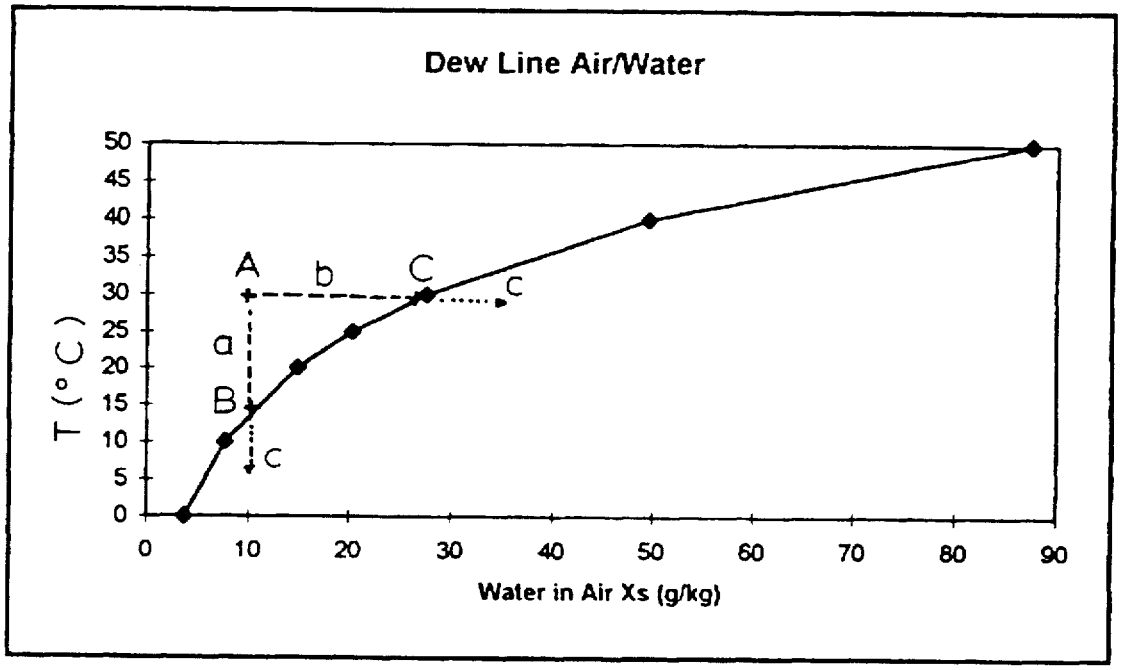

The saturation line for water in air as a function of temperature is set forth in the plot of FIG. 4. FIG. 5 is an expanded plot of FIG. 4 more clearly showing the dew point over a temperature range of 10° C. to 50° C.

Therefore, to prevent premature evaporation of water from a coating composition applied to a substrate, the atmosphere surrounding the coated substrate is maintained either above, at, or near to, the dew point. This can be accomplished by introducing water vapor or a water mist into the atmosphere, by cooling the coated substrate, or a combination thereof. The coated substrate can be cooled by contacting the coated substrate with a cooled gas, a cooled liquid, a supercritical liquid, a cooled solid apparatus, or a mixture thereof.

The temperature and humidity of the atmosphere for preventing premature drying of a water-based coating composition from a substrate can be determined from the plot of FIG. 5. For example, if the prevailing conditions are 30° C. and 36% relative humidity (i.e., 10 g water/kg air) when applying a coating composition to a substrate (i.e., point A of FIG. 5), premature drying of the composition on the substrate can be prevented either by:

(a) cooling the substrate to 15° C. (i.e., to point B of FIG. 5), or (b) increasing the humidity of the air to 26 g/kg (i.e., to point C of FIG. 5) by addition of a water mist or water vapor, or (c) a combination of (a) and (b) such that the temperature and humidity are slightly above, at, or below the dew line.

It should be noted that below the dew line, water can condense on the surface of the coating composition. Such water condensation is not detrimental, but further thins the coating composition and improves flow properties. However, the substrate cannot be cooled to a temperature wherein ice crystals begin to form in the coating layer. The formation of ice crystals, or freezing in general, will retard flow of the coating composition on the substrate.

Figure 6:
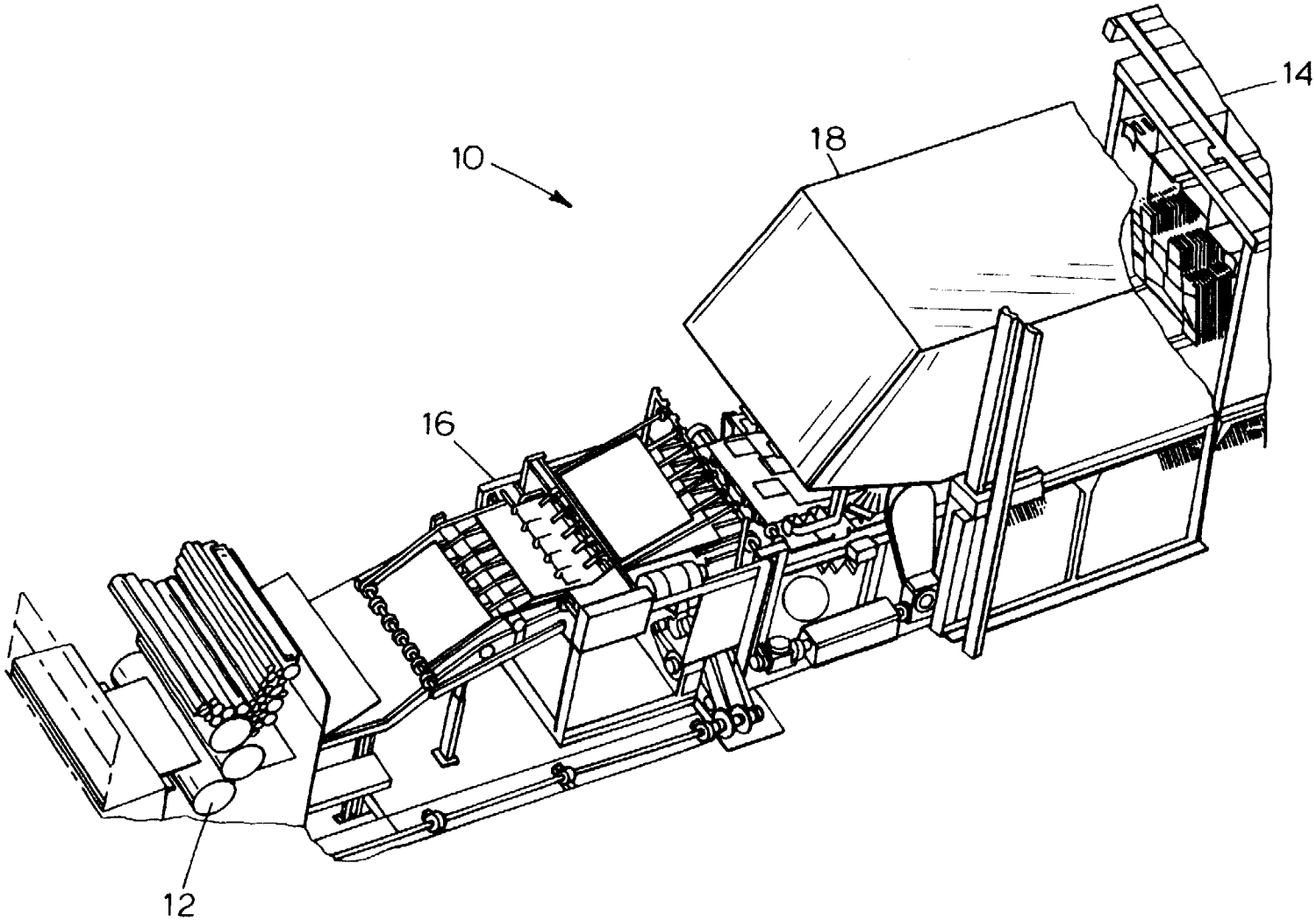
FIG. 6 illustrates a roller coating unit, with transport and oven entrance zone, of the present invention.

FIG. 6 is a schematic, perspective view of a typical apparatus for application of a water-based coating composition onto sheets of a substrate. The substrate can be a metal substrate, such as steel or aluminum, wood, a polymeric substrate, or a composite comprising wood chips and a polymeric binder. The apparatus of FIG. 6 is a standard coating apparatus 10, containing an applicator 12 to apply the coating composition to the substrate, a drying oven 14 to dry the composition on the substrate, and a conveyor means 16 for transporting the coated sheets of substrate from applicator 12 through drying oven 14. Various commercial apparatus are known in the art, for example, the LTG-Mailander, Type 460 (LTG Lufttechnische GmbH, Stuttgart, Germany). Applicator 12 can utilize application rolls or spray nozzles for application of the coating composition onto sheets of the substrate. The coating composition also can be applied to the substrate using a coil coater or a mandrel coater.

Because of premature drying of the coating composition, it has been difficult to achieve a uniform coating of a water-based coating composition on a substrate using apparatus 10 of FIG. 6. To improve apparatus 10 of FIG. 6, a humidifying means is included in the apparatus. The humidifying means is positioned between applicator 12 and drying oven 14. Preferably, the distance between the humidifying means and applicator 12 is kept at a minimum. This distance is determined by the configuration of apparatus 10, such that the humidifying means is positioned as close as possible to applicator 12. Such an arrangement provides conditions suitable for the coating composition to flow after application to the substrate, without premature drying, and thereby provide a uniform coating on the substrate.

Figure 7:
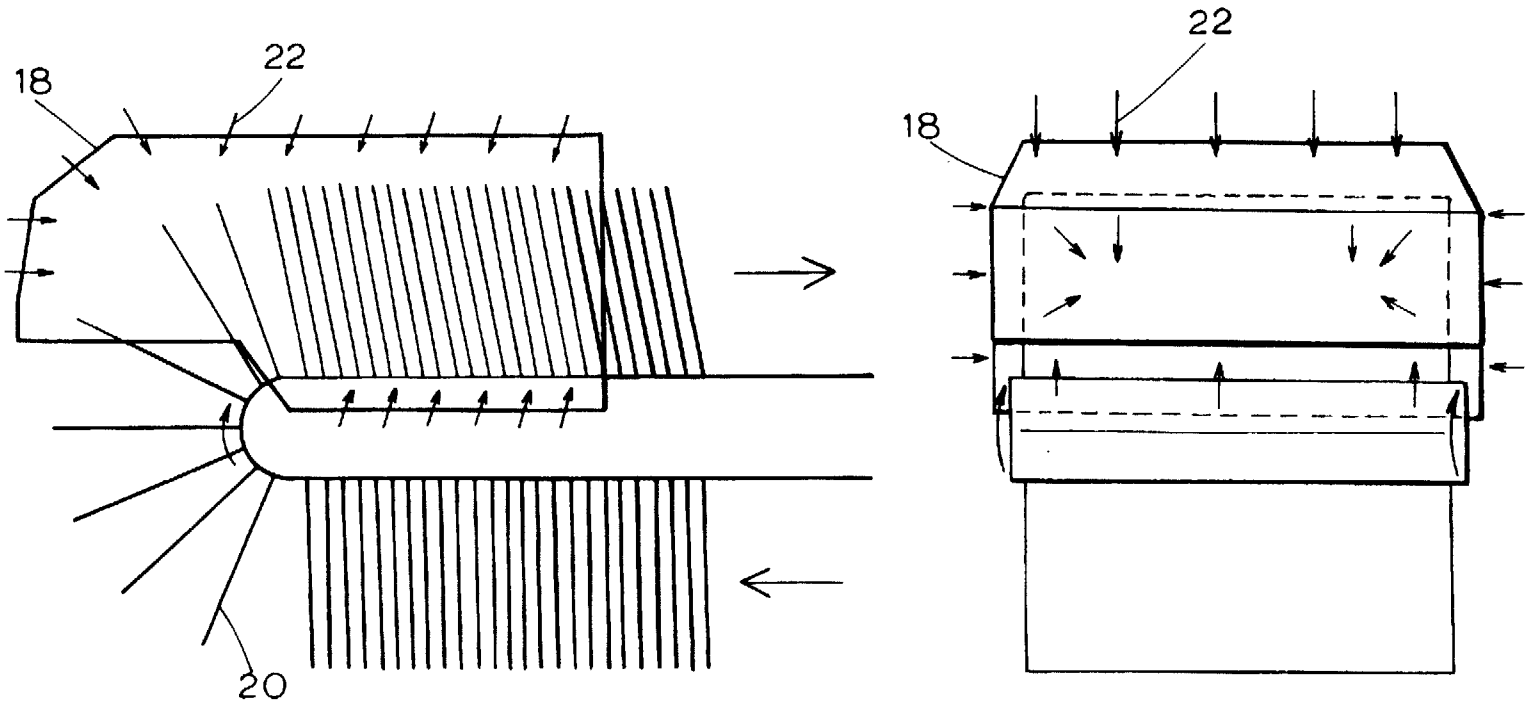
FIGS. 7 and 8 illustrate a humidifying hood of the transport and oven entrance of a roller coating unit.

The humidifying means can be a humidification hood, such as a hood 18 of FIG. 7, that directs water vapor or a water mist to the substrate coated with a water-based coating. Hood 18 also can cool the coated substrate to provide an increased humidity around the substrate. Hood 18 can be adapted further to both provide a water vapor or mist and to cool the substrate.

Humidification hood 18 is positioned above conveyor device 16 such that hood 18 largely covers the upper region of conveyor device 16 without hampering transport of the coated sheets. Hood 18 also can be positioned directly above applicator 12, such that when applicator 12 applies a layer of coating composition to substrate sheets and feeds the sheets to conveyor device 16, the coating composition is humidified after application to the substrate sheets.

Figure 8:
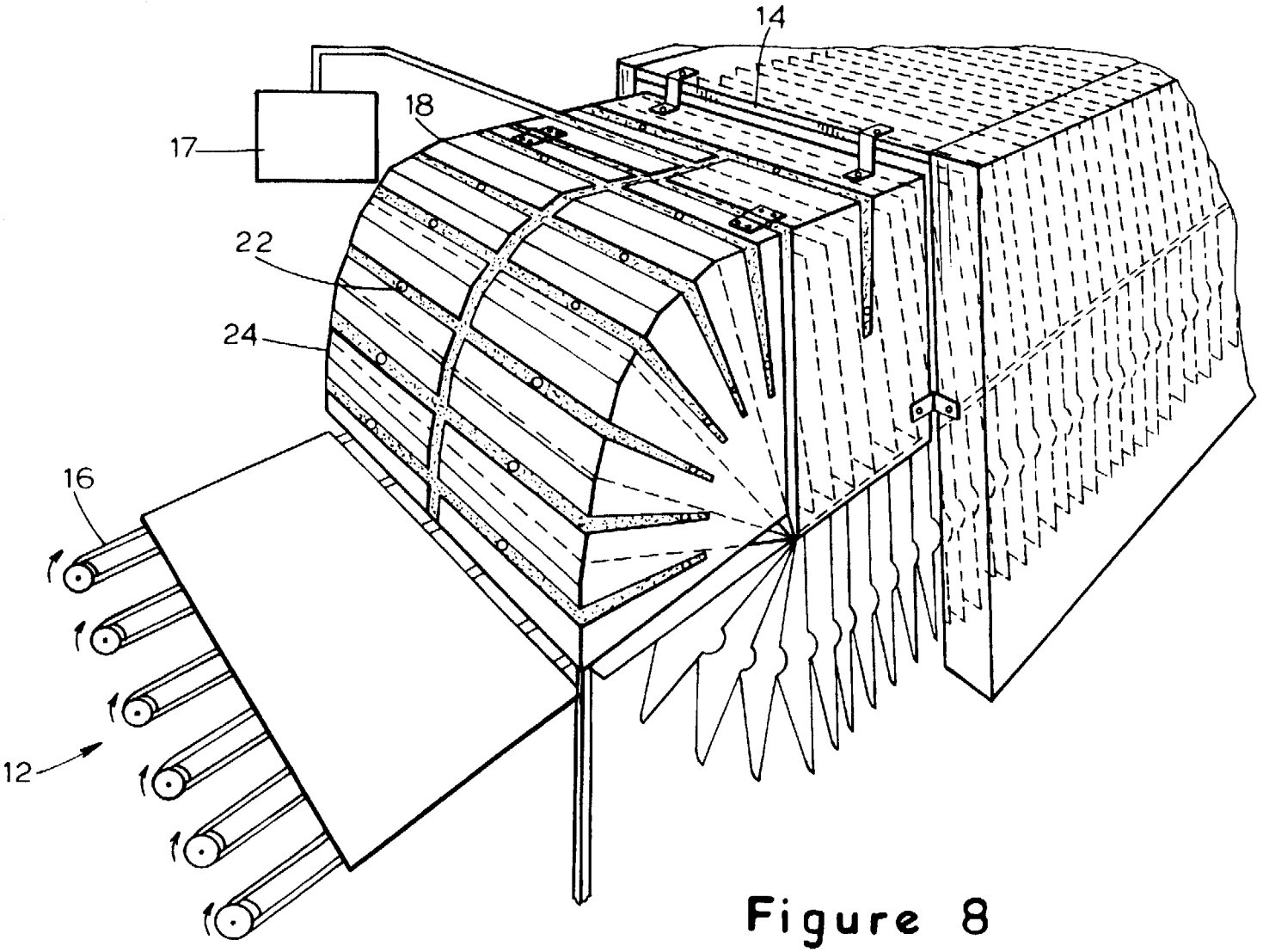

Humidification hood 18 is open on the bottom, and is provided with a plurality of inlet connectors 22, preferably on each side and the top, that are connected to a water vapor or water aerosol generator 17, as illustrated in FIGS. 7 and 8. Such water vapor or aerosol generators are known in the art, and a variety of such generators are described in *Chemical Engineer's Handbook*, R. H. Perry et al. ed., McGraw-Hill, 5th edition, 1973, pp. 18–57. For example, humidity can be introduced by hood 18 by spraying water through nozzles or other vaporizing devices, as a mist from over-saturated gases, or as steam derived from water in a distilling column.

In another embodiment, humidification hood 18 is operatively connected above inlet connectors 22 to a cooling means, in which air is cooled by means of heat exchangers to a temperature in the vicinity of, or below, water vapor saturation of the surrounding air of the apparatus. Such cooling means are known in the art, and a variety are described in *Chemical Engineer's Handbook*, 5th edition, R. H. Perry et al. ed., McGraw-Hill, Chapter 12, 1973.

In another embodiment, the coated substrates are cooled by a gas, like a Joule-Thomson system wherein a compressed gas is allowed to rapidly expand to cool the substrate. The cooled substrate retards premature evaporation of water from the coating composition.

Humidification hood 18 depicted in FIG. 8 generally has a tube or box shape and contains a front 24 facing the applicator 12, which operates in front of hood 18 opposite conveyor device 16. Humidification hood 18 can be provided with a support frame, but can also be releasably attached on the frame of drying oven 14 or conveyor device 16. The shape and material of construction of humidification hood 18 are freely selected with consideration of the operating conditions at the particular application site.

Operation of apparatus 10 generally occurs in known fashion such that the water vapor, mist, or cold air supply to humidification hood 18 is controlled in adjustment to the traveling speed of conveyor device 16 and other parameters. The settings of hood 18 depend on the operating conditions under which the apparatus operates, as well as the type of water-based coating composition employed and the identity of substrates being coated, but in each case the settings are chosen such that essentially complete spreading of the coating composition, i.e., an essentially uniform coating layer on the substrate, is achieved.

Correspondingly designed humidification hoods can be provided on apparatus 10. In the case of roll application, the humidification hood can extend over the roll surface or, if sufficient, only cover the edge region of the rolls. However, in place of a humidification hood, the rolls can be designed as coolable rolls to cool the coating composition and prevent premature drying. In the case of a spray nozzle application, humidification hoods or cooling means can be provided for the spray nozzles in order to keep the nozzles moist, during application runs and down times, and thereby avoid nozzle clogging.

Cooling of air above or below the coated substrates also can be achieved for example, by spraying the uncoated surface of the substrate with coolants that evaporate (e.g., $N_2$ or $CO_2$); blowing of supercooled air over or onto the substrate; or contacting of the coated or uncoated surface of the substrate with a cooled heat exchanger (e.g., cooled roller).

The method of the present invention can be used on sheets of a substrate and in various dryers (e.g., can dryers, both belt dryers and pin oven, and tube lines, like chain transport).

The present method also can be used on the border areas of a substrate where the coating composition has a greater tendency to dry prematurely. For example, the problem exists that water-based coating compositions dry on the cylinder surface and the border areas, which results in the building of skin. To solve this problem, the cylinders can be cooled or moistened with a vapor or mist during operation. The present method also can be used to eliminate the drying problem of water-based coating compositions on spray nozzles by moistening inoperative nozzles with a water vapor or mist.

Obviously, many modifications and variations of the invention as hereinbefore set forth can be made without departing from the spirit and scope thereof, and, therefore, only such limitations should be imposed as are indicated by the appended claims.

What is claimed is:

1. A method of coating a substrate with a water-based coating composition comprising:

(a) applying a layer of the coating composition to the substrate to provide a coated substrate, (b) then humidifying an atmosphere surrounding the coated substrate with a sufficient amount of a water mist to retard evaporation of water from the coating layer on the substrate;

(c) allowing sufficient time for the coating composition on the coated substrate to flow and provide a coating of uniform thickness;

(d) then removing water from the coating composition to dry the coating layer on the substrate.

2. The method of claim 1 wherein the atmosphere surrounding the coated substrate is humidified to at least the dew point.

3. The method of claim 1 wherein the water is removed by air drying the coated substrate.

4. The method of claim 1 wherein the water is removed by heating the coated substrate.

5. The method of claim 1 wherein the coating composition is applied using a roller.

6. The method of claim 1 wherein the coating composition is applied using a spray nozzle.

7. The method of claim 1 wherein the substrate is selected from the group consisting of a metal, wood, a polymeric substrate, and a composite.

8. The method of claim 1 further comprising cooling the coated substrate in steps (a), (b), or (c).

9. A method of coating a substrate with a water-based coating composition comprising:

(a) applying a layer of the coating composition to the substrate to provide a coated substrate, (b) then cooling the coated substrate a sufficient amount to retard evaporation of water from the coating layer on the substrate;

(c) allowing sufficient time for the coating composition of the coated substrate to flow and provide a coating of uniform thickness;

(d) then removing water from the coating composition to dry the coating layer on the substrate.

10. The method of claim 9 wherein the coated substrate is cooled at least to a temperature wherein a water vapor pressure in an atmosphere surrounding the coated substrate is less than 10° C. above the dew point, is at the dew point, or is below the dew point.

11. The method of claim 9 wherein the coated substrate is cooled by contact with a cooled gas.

12. The method of claim 9 wherein the coated substrate is cooled by contact with a cooled liquid or a supercritical fluid.

13. The method of claim 9 wherein the coated substrate is cooled by contact with a cooled solid apparatus.

14. The method of claim 9 further comprising humidifying an atmosphere surrounding the coated substrate in steps (a) or (b).

15. An apparatus for applying a water-based coating composition to a substrate comprising:

(a) means for applying the coating composition to the substrate to provide a coated substrate, said applying means comprising at least one roll or at least one spray nozzle;

(b) means for drying the coated substrate;

(c) means for conveying the coated substrate from the applying means to the drying means; and (d) humidification means to humidify an atmosphere surrounding the coated substrate, said humidification means operatively connected between the applying means and drying means.

16. The apparatus of claim 15 wherein the humidification means generates a water vapor or a water mist to humidify the atmosphere surrounding the coated substrate.

17. The apparatus of claim 15 wherein the applying means comprises at least one roll, and the humidification means is operatively connected to at least one roll of the applying means.

18. The apparatus of claim 15 wherein the applying means comprises at least one spray nozzle, and the humidification means is operatively connected to at least one spray nozzle of the applying means.

19. The apparatus of claim 15 wherein the drying means comprises an oven.

20. The apparatus of claim 15 wherein the applying means comprises a roller coater.

21. The apparatus of claim 15 wherein the applying means comprises a spray coater.

22. An apparatus for applying a water-based coating composition to a substrate comprising:

(a) means for applying the coating composition to the substrate to provide a coated substrate;

(b) means for drying the coated substrate;

(c) means for conveying the coated substrate from the applying means to the drying means; and (d) cooling means to cool the coated substrate, said cooling means operatively connected between the applying means and drying means.

* * * * *